US008510972B2

(12) United States Patent
Bizzo

(10) Patent No.: US 8,510,972 B2
(45) Date of Patent: Aug. 20, 2013

(54) DUAL ZIPPER BOOT CONSTRUCTION METHOD AND SYSTEM

(75) Inventor: Luca Bizzo, Holmdel, NJ (US)

(73) Assignee: Aerogroup International Holdings LLC, Edison, NJ (US)

( * ) Notice: Subject to any disclaimer, the term of this patent is extended or adjusted under 35 U.S.C. 154(b) by 809 days.

(21) Appl. No.: 12/173,315

(22) Filed: Jul. 15, 2008

(65) Prior Publication Data

US 2009/0025256 A1 Jan. 29, 2009

Related U.S. Application Data

(60) Provisional application No. 60/952,145, filed on Jul. 26, 2007.

(51) Int. Cl.
*A43B 3/00* (2006.01)
*A43B 3/02* (2006.01)

(52) U.S. Cl.
USPC ..... 36/50.1; 36/1.5

(58) Field of Classification Search
USPC ..... 36/50.1, 51, 99, 113, 83, 45, 1.5; D2/912, 911
See application file for complete search history.

(56) References Cited

U.S. PATENT DOCUMENTS

| | | | | | |
|---|---|---|---|---|---|
| 1,194,955 | A | * | 8/1916 | Cashmore | 36/50.1 |
| D67,739 | S | * | 7/1925 | Blair | D2/912 |
| 1,684,660 | A | * | 9/1928 | Blair | 36/50.1 |
| 1,771,004 | A | * | 7/1930 | Van Dinter | 36/4 |
| 2,343,477 | A | * | 3/1944 | Ross | 36/10 |
| 2,420,239 | A | * | 5/1947 | Hack | 36/99 |
| 2,891,328 | A | | 6/1959 | Volk | |
| 3,059,352 | A | * | 10/1962 | Clason | 36/50.1 |
| 3,491,465 | A | * | 1/1970 | Martin | 36/99 |
| 3,574,958 | A | | 4/1971 | Martuch | |
| 3,763,579 | A | | 10/1973 | Dexter | |
| 3,765,409 | A | * | 10/1973 | Merkle | 602/28 |
| 3,879,865 | A | * | 4/1975 | Kimball | 36/7.3 |
| 4,217,706 | A | * | 8/1980 | Vartanian | 36/110 |
| 4,392,311 | A | * | 7/1983 | Rudolf et al. | 36/7.3 |
| 4,411,078 | A | | 10/1983 | Bucheder | |
| 4,586,271 | A | | 5/1986 | Maleyko et al. | |
| 4,693,018 | A | | 9/1987 | Maleyko et al. | |
| 4,726,126 | A | * | 2/1988 | Bernhard | 36/89 |
| 5,020,247 | A | | 6/1991 | Barret et al. | |
| 5,167,084 | A | | 12/1992 | Flammier | |
| 5,362,076 | A | * | 11/1994 | Thomas et al. | 280/11.202 |
| 5,704,138 | A | | 1/1998 | Donnadieu | |

(Continued)

FOREIGN PATENT DOCUMENTS

AU 2002100182 4/2002

*Primary Examiner* — Jila M Mohandesi
(74) *Attorney, Agent, or Firm* — Andrew F. Young, Esq.; Lackenbach Siegel, LLP

(57) ABSTRACT

A dual zipper boot construction provides an enhanced comfort-fit for a user and a ready adaptation of the boot to a variety different calf shapes without stressing the boot stitching. A first full-length zipper allows the users to easily slide the boot on while a second mid-length zipper is in an open condition thereby providing additional space. Securing the first full-length zipper secures the boot in position. After the boot is secured in position, the user zips the second mid-length zipper to an optimal comfort-fit position on their calf. Optional elastomeric bridges between the zipper edges of the mid-length zipper allow the boot to accommodate partially zipped uses without disclosing the user's calf and while providing an enhanced style appearance.

9 Claims, 4 Drawing Sheets

(56) References Cited

U.S. PATENT DOCUMENTS

| | | | | |
|---|---|---|---|---|
| 5,784,806 | A | 7/1998 | Wendt | |
| D398,438 | S | 9/1998 | De Baere | |
| 5,950,333 | A * | 9/1999 | Tsen | 36/7.1 R |
| D449,152 | S | 10/2001 | Besko | |
| 6,604,477 | B1 | 8/2003 | Hozan | |
| D527,872 | S | 9/2006 | Choi | |
| D530,488 | S | 10/2006 | Kelsey | |
| 7,131,219 | B2 | 11/2006 | Chen et al. | |
| 2002/0148142 | A1 | 10/2002 | Oorei et al. | |
| 2005/0034333 | A1 | 2/2005 | Chen et al. | |
| 2005/0166426 | A1 | 8/2005 | Donnadieu | |
| 2005/0246921 | A1 | 11/2005 | Baek | |
| 2006/0096126 | A1 | 5/2006 | Krauss | |

* cited by examiner

DUAL ZIPPER BOOT CONSTRUCTION METHOD AND SYSTEM

CROSS REFERENCE TO RELATED APPLICATIONS

This application relates to and claims priority from U.S. Prov. Ser. No. 60/952,145, filed Jul. 26, 2007, the entire contents of which are herein incorporated fully by reference.

SELECTED FIGURE FOR PUBLICATION

FIG. 1

BACKGROUND OF THE INVENTION

1. Field of the Invention

The present invention relates to a new boot construction method and system. More specifically, the present invention relates to a dual zipper boot construction providing an enhanced comfort fit enabling adaptation to a variety of different user-calf shapes and sizes without stressing the boot construction.

2. Description of the Related Art

The related art involves the use of zippers to close boot-type footwear over the arch of the user, and a conventional example of the same may be found in Baleyko et al U.S. Pat. Nos. 4,586,271 and 4,693,018, the entire contents of each of which are incorporated herein by reference. The Bayeyko references also teach the use of a singular tab at the top of a boot calf-extension so that a user may fix the tab ends together providing a single horizontal band of tension on the user's leg.

The related art also teaches conventionally known methods of securing a calf-portion of a boot top to a user's calf. See for example, Chen et al. U.S. Pat. No. 7,131,219 where it is shown to include a lacing slot on a rear-portion of a boot or high-top sneaker. The construction in Chen allows a user to only tighten the laces at a single lateral location for comfort. Unfortunately, this leaves the remaining top portion fitting loosely to the calf and causing chafing.

It is also conventionally recognized that certain knee-high ladies boots are constructed from continuous elastomeric fabric along a standardized calf-region thereby allowing a user to grip a top member of a boot-top rim and pull upwardly away from a user's heal allowing the boot top to fit in place. Unfortunately, constructions involving elastomeric calf regions provide a number of detriments to ultimate user comfort, long wear, and adaptability to differing user physical shapes. For example, after a reasonably short period of continuous use (for example 6-months) conventional elastomeric fibers used in this construction degrade and no longer provide the same elastic coefficient, and consequently a differing fit. Additionally, such constructions necessarily originate with a defined "common-shape" construction that also necessarily leaves out members of the populace who have particularly large, narrow, or distending calf-shapes.

Those with such unusual calf-shapes are prohibited from such conventional constructions because their calf-shape is outside the normal design parameters of the prepared boot. Finally, it is recognized that such conventional elastomeric boot calf-constructions are not adaptable to natural non-elastomeric materials such as leather, woven cloth, etc., thereby preventing the user of desirable fashion construction medial.

What is not appreciated by the prior art is the need for a boot construction that readily adapts to a wide variety of user shapes (outside the norm), is adapted to use of elastomeric materials as part of an additional construction, and allows most-importantly a boot product to adapt to user's individual placement preference on a changing day-to-day basis (for example during water-gain time periods), all while providing an attractive appearance about a user's ankle and lower-calf region allowing them to wear pants.

Accordingly, there is a need for an improved boot construction that responds to at least one of the needs noted above.

OBJECTS AND SUMMARY OF THE INVENTION

An object of the present invention is to provide a dual zipper boot construction and method that responds to at least one of the needs noted above.

Another object of the present invention is to provide a dual zipper construction method that allows the adaptive use of both inelastic and elastic materials while providing a pleasing outer appearance.

It is another object of the present invention to provide a dual zipper boot construction method that preserves an attractive boot-appearance when in a partially secured position while a user is wearing pants.

The present invention relates to a dual zipper boot construction which provides an enhanced comfort-fit for a user and a ready adaptation of the boot to a variety of different calf shapes without stressing the boot stitching. A first full-length zipper allows the users to easily slide the boot on while a second mid-length, i.e., boot upper portion zipper remains in an open condition thereby providing additional leg receptive space. Securing the first full-length zipper secures the boot in position. After the boot is secured in position, the user zips the second mid-length zipper to an optimal comfort-fit position on their calf. Optional elastomeric bridges between the zipper edges of the mid-length zipper allow the boot to accommodate partially zipped uses without disclosing the user's calf and while providing an enhanced style appearance.

According to an embodiment of the present invention there is provided a dual zipper boot construction enabling an enhanced comfort-fit for a user relative to a user's calf shape, comprising: an extended calf-length boot of a flexible body member having an upper body portion carrying a boot heel and a sole piece, a first zipper extending along a length of the boot from a top edge of said upper body portion to a terminus location proximal above said sole piece, the first zipper in fully open condition enabling user leg entry access to said body member, the first zipper being zipped to full closed condition position to secure the boot on the user calf. An imaginary line in said upper body portion defines a hem region located a distance above said first zipper terminus location. A second zipper extends from a bottom end thereof located a distance above said hem region to the top edge of the upper body portion, and generally in a parallel orientation relative to the first zipper, whereby the user may secure the boot to the user's calf with the first zipper, and may selectively adjust an adjustment length of the second zipper above the hem region to obtain a partially-zipped comfort-fit position without displaying any second zipper partial only closure appearance or comfort-fit position below said hem region. According to another embodiment of the present invention, there is provided a method of constructing a dual zipper boot, comprising the steps of: providing an extended calf-length boot having an upper-leg portion and a foot portion, providing a tread-sole on the boot bottom spacing the boot from a support surface, providing a first zipper extending along a length of the boot from proximate the tread-sole to a top of the upper-leg portion enabling a zipper-foot access for the user to initially secure the boot to the user, the first zipper extending along the length of the boot generally in parallel to a user's foot direction and parallel to a side of the user's foot, providing a hem region recognized along said upper-leg portion of the boot between the tread-sole on the boot bottom and the top of the upper-leg portion, and providing at least a second zipper extending from above the hem region to the top of the upper-leg portion, and generally in a parallel orientation relative to the first zipper, whereby the user may secure the boot to the user's calf with the first zipper, and may selectively adjust an adjustment length of the second zipper above the hem region to obtain a partially-zipped comfort-fit position without disclosing the partially-zipped comfort-fit position below the hem region.

The above, and other objects, features and advantages of the present invention will become apparent from the following description read in conduction with the accompanying drawings, in which like reference numerals designate the same elements.

DETAILED DESCRIPTION OF THE PREFERRED EMBODIMENTS

Figure 1:
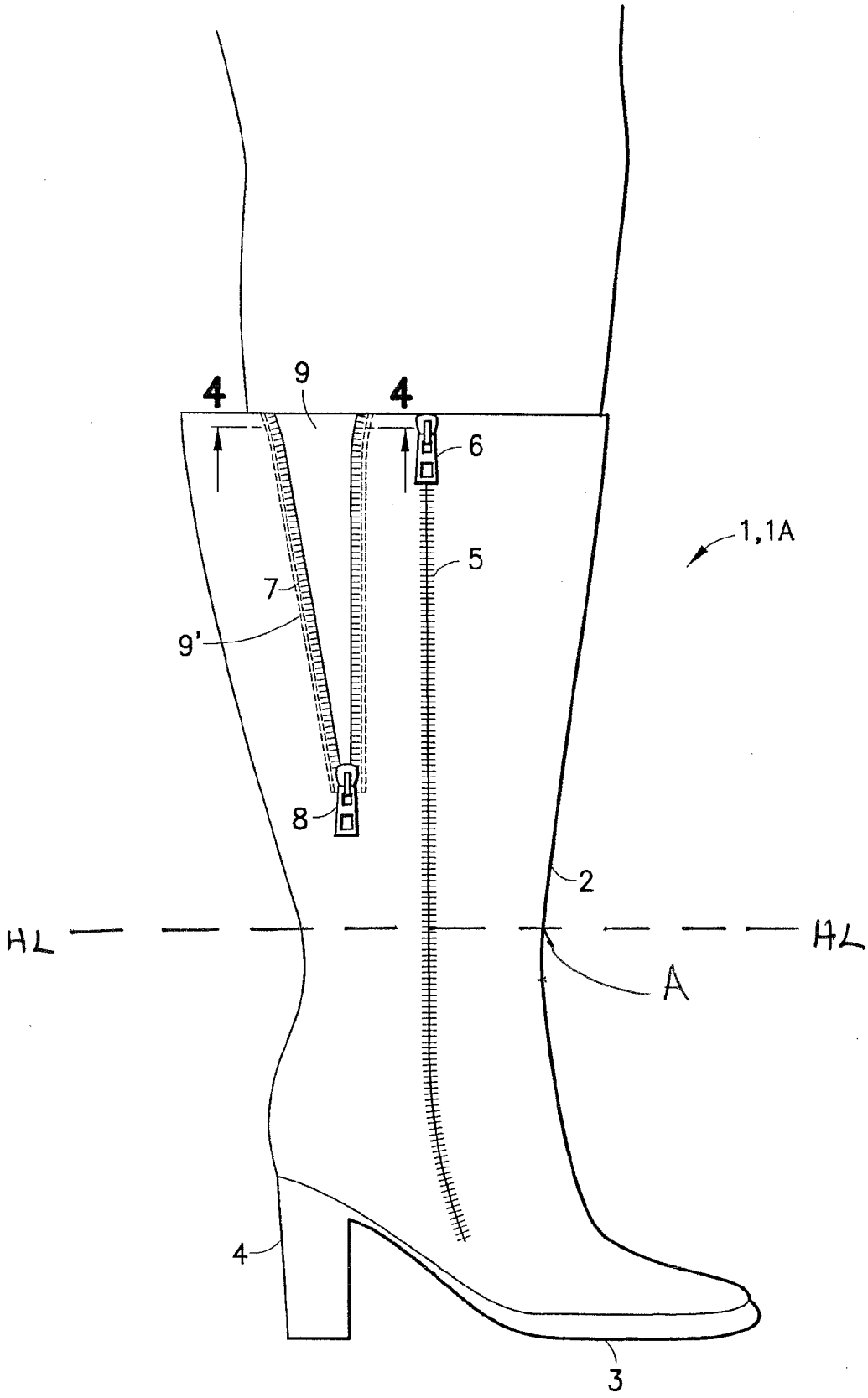
FIG. 1 is a side view of one embodiment of the present dual zipper invention on a user's calf shown with the first zipper in zipped closed condition and the second zipper in an unzipped condition, prior to user making any fit adjustment of the boot on the user's leg.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices.

Referring now to FIGS. 1 through 6 a proposed dual-zipper boot construction 1 is provided enabling a comfort-fit use for each individual user no matter shape of their particular calf.

Boot construction 1 includes a heel member 4, a sole or tread member 3, an upper member 2 and a central seam 5 having a zipper 6 allowing a user to initially secure boot 1 in position on their leg during an initial position step. Conventionally, it is recognized that a single zipper 6 may be employed for securing a boot to a user's leg but the use of such a single zipper necessarily mandates and prohibits a use by users other than those having calf-shapes matching the predetermined boot shape profile. Consequently, the presently proposed comfort-fit construction was developed.

In a first boot-installation position 1A for boot 1, zipper 6 is fully secured and boot 1 is generally secured to a user's leg.

A second zipper construction 7, having engagable/disengagable first and second zipper sides 7A, 7B (FIG. 4), and a zipper pull member 8 is provided in the upper body portion on the side of a user's leg, positioned as shown, allowing expansion and contraction in a direction parallel to a horizontal plane through a user's calf (as opposed to a location on a front shin-part of a boot).

An opening between zipper portions 7A, 7B may be optionally open, but is preferably bridged by a flexible member 9, that may be constructed from any conventionally known and suitable material. Most preferably flexible member 9 may be constructed from an elastomeric material such as elastic, neoprene, etc., but natural materials such as leather, silk, and textiles of all kinds may also be employed, selected from all those flexible materials known to those of skill in the art.

As necessary, the shape and size of flexible member 9 may be constructed to allow an overlap or flexible loop portion (See FIGS. 5 and 6) located internal to the boot 1 when zipper 7 is in the fully contracted state and sides 7A, 7B are partially or fully engaged. It will be understood, that this type of construction may be employed with zipper 7 without departing from the scope and spirit of the present invention.

Connection regions 9' connect sides of flexible member 9 to boot sides 2 proximate zipper edges 7A, 7B as shown, and function to secure flexible member 9 as shown. In alternative embodiments, it is envisioned that any form of connection system may be used that is known to those of skill in the art, including stitching, adhesion, hook-loop closures, heat-welding, etc.

Figure 2:
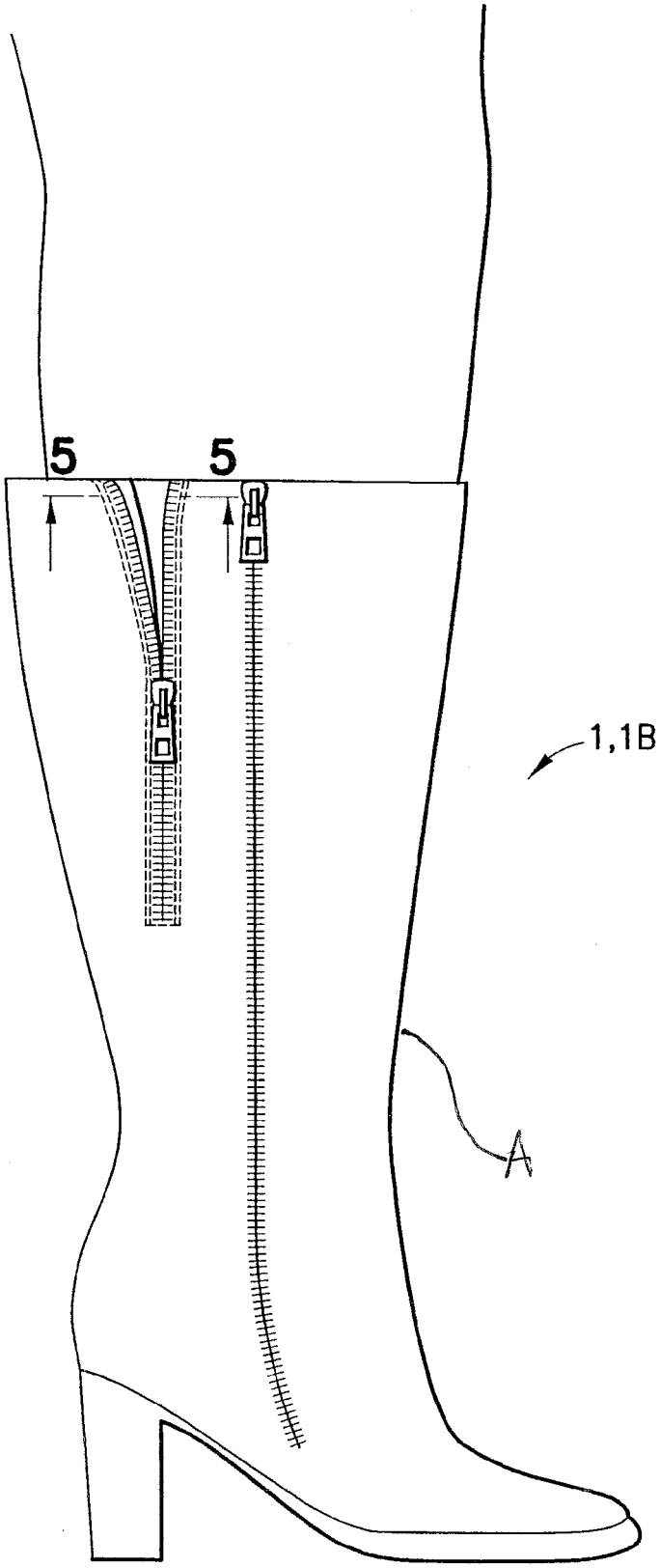
FIG. 2 is a side view of the embodiment in FIG. 1 shown in a user-selected second zipper partial-zip position employed to effect a desired user comfort.
Figure 3:
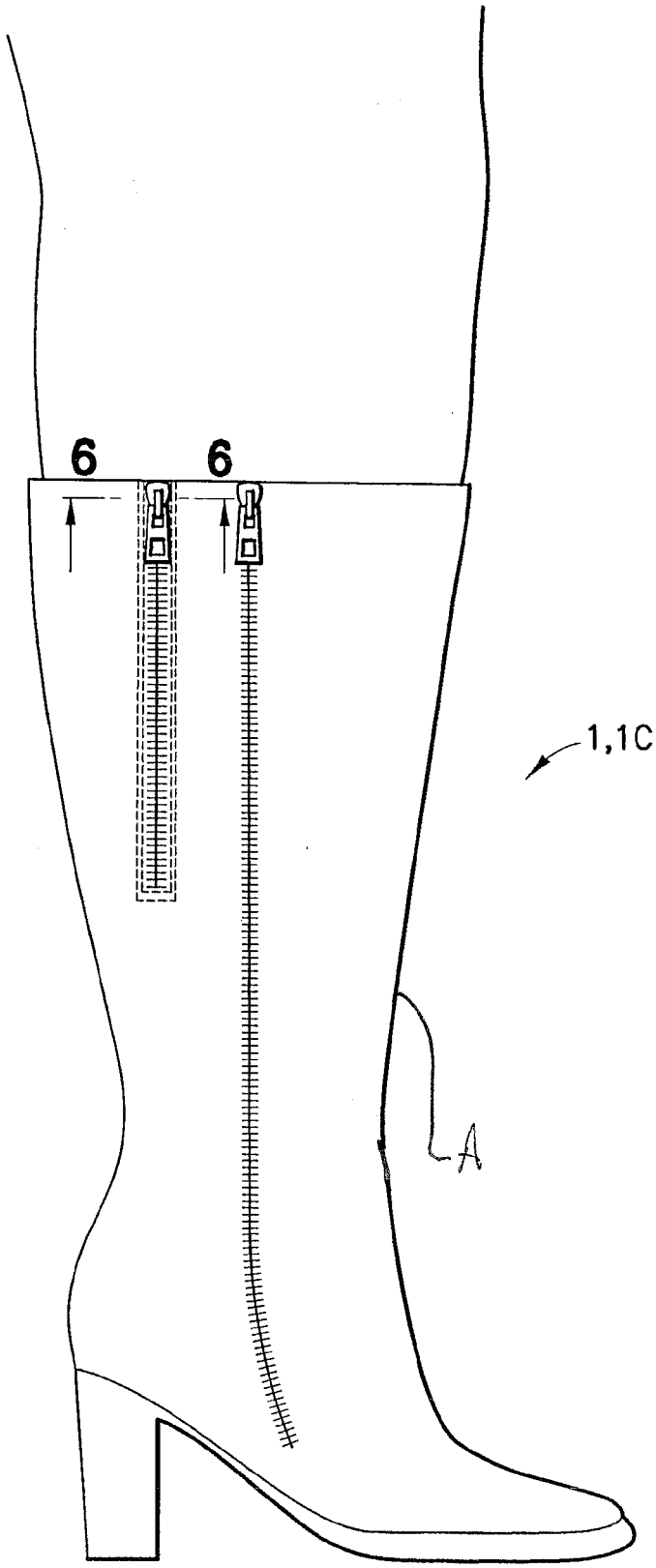
FIG. 3 is a side view of the embodiment of FIG. 1 shown in a fully-zipped condition for use on a user with narrower calves than associated with a user having calf dimensions requiring a FIG. 2 fit.
Figure 4:
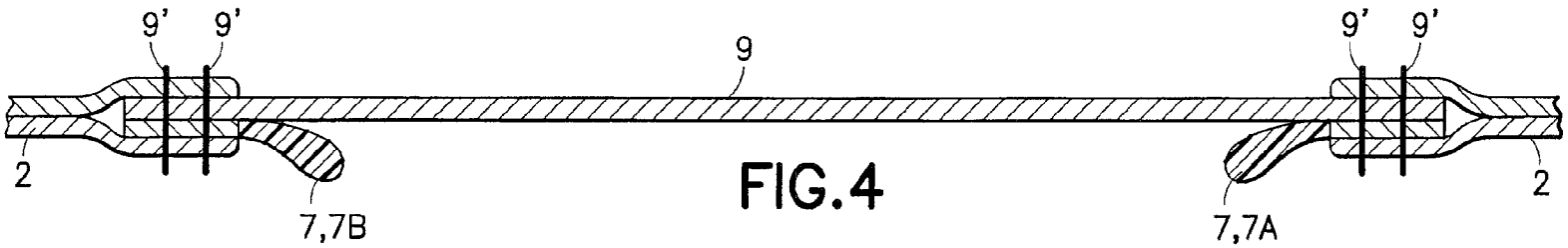
FIG. 4 is a cross sectional view along line 4-4 in FIG. 1.
Figure 5:
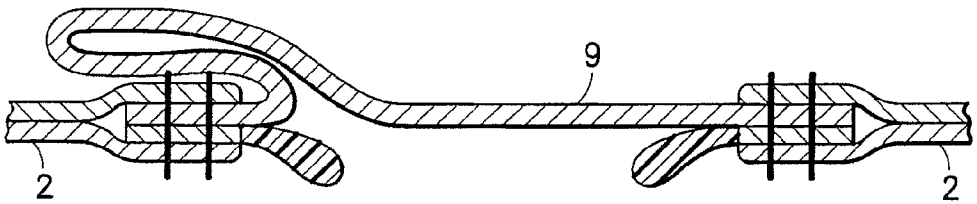
FIG. 5 is a cross sectional view along line 5-5 in FIG. 2.
Figure 6:
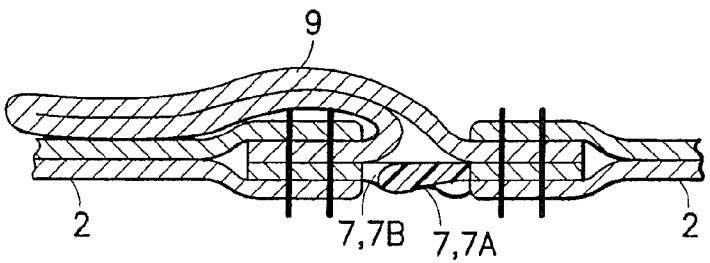
FIG. 6 is a cross sectional view along line 6-6 in FIG. 3.

Referring now to FIGS. 1-3, it is additionally noted that a pant-cuff or hem region location A is defined by an imaginary line HL passing through said upper body portion along a level location relative to a support floor surface, such that a user, wearing pants, will not have the second zipper 7 or any partial only closure disclosed to view during use or appearing below said hem region. As used herein, the pant-cuff region A will be generally understood by those of skill in the art as representing the level line where a pant leg hem would fall but it will also be recognized that this location is not specific but is general in nature due to the variability between pant-hem locations, pant hem styles, and personal pants-wearing preferences. Nonetheless, those of skill in the art will recognize that pant-cuff region A is readily understood as a generally recognizable hem region on a boot without departing from the scope and spirit of the present invention.

As shown respectively in FIGS. 2 and 3, intermediate and fully zipped positions 1B, 1C of second zipper 2 are noted. During a use process, it is recognized that a user may initially put a boot on and secure the boot in position 1A in FIG. 1, with the second zipper 7 being in an open condition. During an intermediate positioning at 1B in FIG. 2, a user adjusts a height of zipper 7 to a comfort position which may be in a middle position. However, since the entire length of zipper 7 is above the hem region or pant-cuff location A of the boot, the intermediate middle position of zipper pull 8 is not visible or displayed to the public, thereby allowing a user to employ boot 1 in a partially-zipped condition without disclosing the unfashionable partially-zipped condition.

In a related example, it is recognized that humans often have variation in similar body parts in shape, size, etc., including differing shaped calf muscles. In a similar example, a user may experience a calf/leg deformity or injury that requires compensating for an unusual or difficult shape, but desires to purchase boots conventionally (via retailers) and not via a custom-footwear merchant due to the expense and lack of style options. Often these differences are minor, but annoying to compensate for in mass-produced footwear, but in other circumstances the differences can be a major source of personal concern and embarrassment and the ultimate goal of each user is achieving a comfort-fit for their footwear.

In view of the above, it will also be recognized that zipper 7, and the adaptability of the same as a means for continuous and varied adjustment, may be adapted to the use of lacing.

Additionally, it will be recognized that the use of the present construction allows a manufacturer to employ an elastomeric material for boot body 2, and with the inclusion of dual zippers 7, 6, allows a user to achieve the beneficial uses of the elastomeric material (adaptation to calf-shapes), but without the requirement for unduly stressing the elastomeric material causing premature failure and degradation.

In either circumstance, a user may position one boot in position 1B (partially zipped position) or position 1A (fully unzipped), and the second boot in position 1C (fully zipped), all without disclosing the use of differently adjusted boots below the cuff or hem region A on either boot. Here, the present invention allows ready user-adaptation to a personal physiological difference in leg shape and provides a comfort-fit to each user when the adjustment zipper 7 is positioned close to and generally parallel with the securing zipper and in a direction to pull the sides of boot 2 comfortably into position on a calf for each individual user.

In the claims, means- or step-plus-function clauses are intended to cover the structures described or suggested herein as performing the recited function and not only structural equivalents but also equivalent structures. Thus, for example, although a nail, a screw, and a bolt may not be structural equivalents in that a nail relies on friction between a wooden part and a cylindrical surface, a screw's helical surface positively engages the wooden part, and a bolt's head and nut compress opposite sides of a wooden part, in the environment of fastening wooden parts, a nail, a screw, and a bolt may be readily understood by those skilled in the art as equivalent structures.

Having described at least one of the preferred embodiments of the present invention with reference to the accompanying drawings, it is to be understood that the invention is not limited to those precise embodiments, and that various changes, modifications, and adaptations may be effected therein by one skilled in the art without departing from the scope or spirit of the invention as defined in the appended claims.

What is claimed is:

1. A multi-zipper carrying boot structure enabling enhanced user comfort-fit relative to a user's calf shape and size, said boot structure comprising: a boot body member having a flexible body, said flexible body including an upper body portion and a lower body portion, said lower body portion carrying a boot heel and a boot sole piece; a first zipper in said flexible body extending downwardly a distance from a top edge of said upper body portion to a terminus thereof proximal to said boot sole piece, said first zipper in a fully open condition on said flexible body enabling a user leg entry access into said flexible body; and a second zipper in said flexible body extending adjacent said first zipper downwardly from said top edge of said upper body portion to a terminus thereof proximal to a position in said upper body portion defining a hem region located a distance above said terminus of said first zipper, wherein said first zipper is zipped upward to full closure position to secure said boot body member to said user calf, wherein said second zipper is zipped selectively upwardly from an open position in closing travel thereof toward said top edge of said upper body portion until said closing travel of said second zipper produces a comfort-fit position of said upper body portion on said user calf without a display of any portion of said second zipper below said hem region; wherein said first zipper extends downwardly longitudinally on said boot structure and parallel to a side of said user's leg, said second zipper extends in said body member generally in parallel orientation with said first zipper, and said first zipper and said second zipper are located on a side of said boot body member.

2. The boot structure in accordance with claim 1, said boot structure further comprising: a flexible member having opposite sides affixedly connected to respective side regions of an opening in said upper body portion to bridge said opening, wherein said second zipper has first and second cooperatively engagable/disengagable sides affixed to said respective side regions of said opening proximal to said opposite sides of said flexible member.

3. The boot structure in accordance with claim 2, wherein said flexible member is one of a synthetic material and a natural material.

4. The boot structure in accordance with claim 3, wherein said synthetic material is an elastomeric material.

5. The boot structure in accordance with claim 2, wherein said natural material is selected from the group consisting of leather, silk and textile.

6. A method for making a multi-zipper carrying boot structure enabling enhanced user comfort-fit relative to user's calf shape and size, said method comprising the steps of:

(a) providing a boot body member having a flexible body, said flexible body including an upper body portion and a lower body portion;

(b) providing said lower body portion with a boot heel and a boot sole piece;

(c) providing said boot body member with a first zipper extending downwardly from a top edge of said upper body portion to a terminus thereof proximal to said sole piece, said first zipper in a fully open condition on said boot body member enabling a user leg entry access to said boot body member;

(d) providing said boot body member with a second zipper spaced apart from and adjacent to said first zipper and extending downwardly from said top edge of said upper body portion to a terminus thereof in said upper body portion located proximal to a position in said upper body portion defining a hem region located a distance above said first zipper terminus;

(e) zipping said first zipper to a fully closed condition securing said boot body member on said user calf;

(f) selective upward closing travel of said second zipper toward said top edge of said upper body portion to produce comfort-fit positioning of said upper body portion on said user's calf without a display of any portion of said second zipper below said hem region; and wherein said first zipper extends longitudinally on said boot structure and parallel to a side of said user's leg, said second zipper extends in said body member generally in parallel orientation with said first zipper, and wherein said first zipper and said second zipper are located on a side of said boot body member.

7. A multi-zipper carrying boot structure enabling enhanced user comfort-fit relative to user's calf shape and size, said boot structure comprising: a boot body member having a flexible body, said body member having a top edge defining a boot top opening for reception entry of a user leg to said boot, said body member carrying a heel and a sole piece at a bottom of said body member; a first zipper carried in said body member extending downwardly from said top edge to a terminus thereof proximal to said sole piece, said zipper being zipped upwardly in closing travel to encircle and tighten the body member about said user's calf; and a second zipper extending from said body member top edge downwardly a distance having a terminus in said body member a distance above a position in said body member defining a hem region located a distance above said terminus of said first zipper, wherein closure of said second zipper in upward closing travel further tightening said body member on said user's calf until said closing travel of said second zipper produces a comfort positioning-fit of said body member on said user's calf without a display of any portion of said second zipper below said hem region; and wherein said first and second zippers extend longitudinally on said boot structure spaced apart from, adjacent to, and substantially parallel with another on a side of said body member.

8. The boot structure in accordance with claim 7, further comprising a flexible member having opposite sides affixedly connected to respective side regions of an opening in said body member top edge to bridge said opening, wherein said second zipper has first and second cooperatively engagable/disengagable sides affixed to said respective side regions of said opening proximal to said opposite sides of said flexible member.

9. A dual zipper boot construction enabling an enhanced comfort-fit for a user relative to user's calf shape, said boot construction comprising: an extended calf-length boot having an upper-leg portion and a foot portion; a tread-sole on said boot bottom spacing said boot from a support surface; a first zipper extending along a length of said calf-length boot from proximate said tread- sole to a top of said upper-leg portion enabling a zipper-foot access for a foot of said user to initially secure said calf-length boot to said user's foot and calf; said first zipper extending along said length of said calf-length boot generally in parallel to said user's foot parallel to a side of said user's foot; a hem region located along said upper-leg portion of said boot between said tread-sole on said boot bottom and said top of said upper leg portion; and a second zipper extending from above said hem region to said top of said side of the upper-leg portion, and generally in a parallel orientation relative to said first zipper, wherein said user may secure said boot to said user's calf with said first zipper, and may selectively adjust an adjustment length of said second zipper above said hem region to obtain a partially-zipped comfort-fit position of said second zipper without disclosing said partially-zipped comfort-fit position below said hem region.

* * * * *